US007341035B2

(12) United States Patent
Kassner et al.

(10) Patent No.: US 7,341,035 B2
(45) Date of Patent: Mar. 11, 2008

(54) DEVICE AND METHOD FOR CONTROLLING AN INTERNAL COMBUSTION ENGINE

(75) Inventors: Uwe Kassner, Moeglingen (DE); Jochen Laubender, Stuttgart (DE); Andre-Francisco Casal Kulzer, Boeblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/579,666

(22) PCT Filed: Jul. 25, 2005

(86) PCT No.: PCT/EP2005/053599

§ 371 (c)(1),
(2), (4) Date: May 18, 2006

(87) PCT Pub. No.: WO2006/013168

PCT Pub. Date: Feb. 9, 2006

(65) Prior Publication Data

US 2007/0079782 A1 Apr. 12, 2007

(30) Foreign Application Priority Data

Jul. 30, 2004 (DE) ..... 10 2004 037 167

(51) Int. Cl.
*F02N 11/08* (2006.01)
*F02N 17/00* (2006.01)

(52) U.S. Cl. ..... 123/179.3

(58) Field of Classification Search ..... 123/179.3, 123/179.4

See application file for complete search history.

(56) References Cited

U.S. PATENT DOCUMENTS

| | | | | |
|---|---|---|---|---|
| 5,447,138 | A | 9/1995 | Barnes et al. | |
| 6,340,016 | B1 | 1/2002 | Ueda et al. | |
| 6,615,785 | B2 * | 9/2003 | Weiss | 123/179.28 |
| 6,910,454 | B2 * | 6/2005 | Sieber et al. | 123/182.1 |
| 6,981,481 | B2 * | 1/2006 | Kojima et al. | 123/179.3 |
| 7,082,899 | B2 * | 8/2006 | Hanson et al. | 123/179.5 |
| 7,104,235 | B2 * | 9/2006 | Brehob et al. | 123/179.5 |
| 7,134,414 | B2 * | 11/2006 | Ries-Mueller et al. | 123/179.3 |
| 7,174,252 | B1 * | 2/2007 | Kolmanovsky et al. | 123/90.15 |
| 7,182,062 | B2 * | 2/2007 | Beer et al. | 123/491 |
| 7,207,305 | B2 * | 4/2007 | Dolker | 123/179.3 |

FOREIGN PATENT DOCUMENTS

| | | |
|---|---|---|
| EP | 0 889 224 | 1/1999 |
| EP | 1 036 928 | 9/2000 |
| EP | 1 403 511 | 3/2004 |

* cited by examiner

*Primary Examiner*—Hai Huynh
*Assistant Examiner*—Arnold Castro
(74) *Attorney, Agent, or Firm*—Michael J. Striker

(57) ABSTRACT

The invention relates to a method and a device (1) for controlling an internal combustion engine upon starting, having a detection means (420) which detects operating parameters of the engine, in which a calculation means (410), taking the detected operating parameters before the start of the engine into account, specifies a starting strategy, and the calculation means (410), as a function of the specified starting strategy, defines control parameters for controlling a runup to engine operating speed, and a control means (430) monitors the runup to engine operating speed, and in the event of a runup to engine operating speed that deviates from the starting strategy, the control means (430), adapts the control parameters accordingly.

13 Claims, 3 Drawing Sheets

DEVICE AND METHOD FOR CONTROLLING AN INTERNAL COMBUSTION ENGINE

Figure 1:
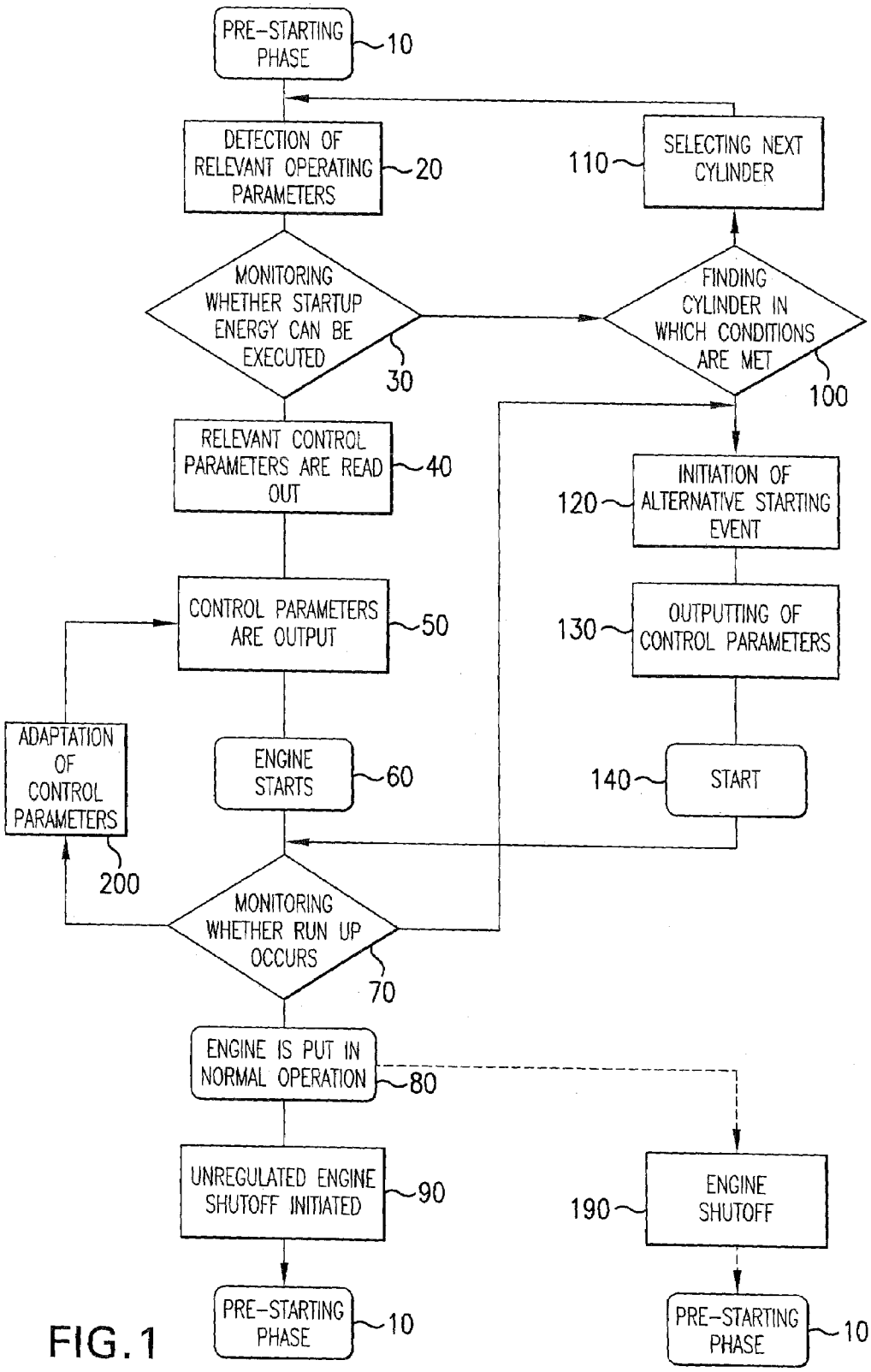

The invention is based on a device for controlling an internal combustion engine as generically defined by the preamble to the first independent main claim. The invention also relates to a method as generically defined by the preamble to the second independent main claim.

PRIOR ART

For reducing motor vehicle fuel consumption and emissions, so-called start-and-stop methods are becoming increasingly widely used. In the present start-and-stop method, engine starting is done by means of an electrical machine, such as a belt- or crankshaft-type starter-generator, or a conventional starter. Typically, the start is done as the engine runs up to speed by injecting fuel and then igniting it, generating an engine torque, and once the engine is at a high enough rpm, the starter is disengaged again.

From European Patent Disclosure EP 1 036 928 A2, a starting device is known, in which upon shutoff of the engine, at least one cylinder entering compression is identified, and when there is a starting request, fuel is injected into that cylinder.

ADVANTAGES OF THE INVENTION

The device of the invention having the characteristics of the independent claim has the advantage over the prior art that a detection means detects operating parameters of an internal combustion engine, and a calculation means specifies a starting strategy, taking the detected operating parameters before a start of the engine into account, and as a function of the specified starting strategy, the calculation means defines control parameters for controlling a runup to engine operating speed, and a control means monitors the runup to engine operating speed and adapts the control parameters accordingly in the event of a runup to engine operating speed that deviates from the starting strategy.

The corresponding method of the invention accordingly has the advantage that before a start of the engine, taking detected operating parameters into account, a starting strategy for starting the engine is specified, and that as a function of the specified starting strategy, control parameters for controlling a runup to engine operating speed are defined, and the runup to engine operating speed is monitored, and if the runup to engine operating speed deviates from the starting strategy, the control parameters are adapted such that a runup to engine operating speed specified by the starting strategy is attained.

Proceeding in this way has the particular advantage that even before the start of the engine, or in other words even before the crankshaft is set into motion, a starting strategy is defined according to which the start and the corresponding runup to engine operating speed are to be effected. In particular, the starting strategy can be adapted to the various existing starting conditions, which can be ascertained as a function of the operating parameters, so that the start of the engine can be done optimally. Since even before the start, control parameters are determined as a function of the defined starting strategy, the runup to engine operating speed to be expected in accordance with the starting strategy is advantageously known. If the monitored runup to engine operating speed deviates from the expected runup to engine operating speed, then it is provided according to the invention that the control parameters be adapted such that the runup to engine operating speed takes place in such a way that the starting strategy is optimally put into practice.

By the provisions recited in the dependent claims, advantageous refinements of and improvements to the method defined by the independent claim are possible.

It is especially advantageous if the detection means detects a piston position of at least one cylinder, and a calculation means specifies a starting strategy, taking into account the at least one piston position detected before the start of the engine. As a function of a known piston position of at least one cylinder, all the further working strokes are to be determined before the onset of the start, and it is thus advantageously possible to adapt both the starting strategy and the control parameters accordingly.

It is also advantageous if the detection means detects a piston position of at least one cylinder which is the first to enter compression or an intake stroke upon starting, and the calculation means specifies a starting strategy, taking into account at least the piston position detected before a start of the engine. If in a direct-injection internal combustion engine, the piston position of a cylinder that enters compression first is known, or an internal combustion engine with intake manifold injection the piston position of the cylinder that enters the intake stroke first is known, then the starting strategy can advantageously be adapted accordingly. For instance, in the event of an unfavorable piston position, it may be provided that injection into that cylinder or into the intake manifold in the relevant stroke be dispensed with, and that the starting strategy be adjusted accordingly.

In a further advantageous feature, it is provided that a memory means stores the control parameters, adapted by the control means upon the runup to engine operating speed, in memory, and that the control means, upon a repeated runup to engine operating speed that deviates from the starting strategy, accesses the control parameters stored in memory. For instance from an adaptive performance graph, upon a new start time-tested control parameters can advantageously be accessed, so that from the very onset the runup to engine operating speed can proceed optimally.

It is also advantageous if in an engine with variable valve control, the calculation means defines control parameters for valve control such that the runup to engine operating speed follows the specified starting strategy. It is thus advantageously possible to make use of additional options in terms of influence, to design a runup to engine operating speed optimally.

It is also advantageous if in an engine with variable compression, the calculation means defines control parameters for compression control such that the runup to engine operating speed follows the specified starting strategy. It is thus advantageously possible to make use of additional options in terms of influence, to design a runup to engine operating speed optimally.

It is also advantageous if the starting strategy defines control parameters which trigger a starter or starter-generator variably over time in its performance and/or rpm. This has the advantage that with a variably triggerable starter, the mixture preparation during the compression or intake phase, the temperature that occurs upon compression in the combustion chamber, and the torque output by the starter can also be adapted, thus offering further degrees of freedom in defining a starting strategy and performing an optimal start.

In a further exemplary embodiment it is provided that the calculation means, as a function of the operating parameters detected before the start of the engine, recognizes a possible self-ignition operating state of the engine and specifies a starting strategy which prevents this self-ignition operating state. From the detected operating parameters, it is advantageously possible to predict a potential self-ignition operating state and adapt the starting strategy to be specified such that this operating state is avoided or prevented.

It is also especially advantageous if the devices of the invention are also designed as methods.

In a further advantageous feature, a computer program product with a program code is provided, and the program code is stored in memory on a machine-readable medium for performing at least one of the methods of the invention, when the program is executed on a computer or control unit. This has the particular advantage that the method of the invention can be made available independently of a device.

DRAWINGS

Further characteristics, possible applications, and advantages of the invention will become apparent from the ensuing description of exemplary embodiments of the invention, which are shown in the drawings. All the characteristics described or shown, alone or in arbitrary combination, form the subject of the invention, regardless of how they are summarized in the claims or the claims dependency and regardless of their wording and illustration in the description and drawings.

Figure 2:
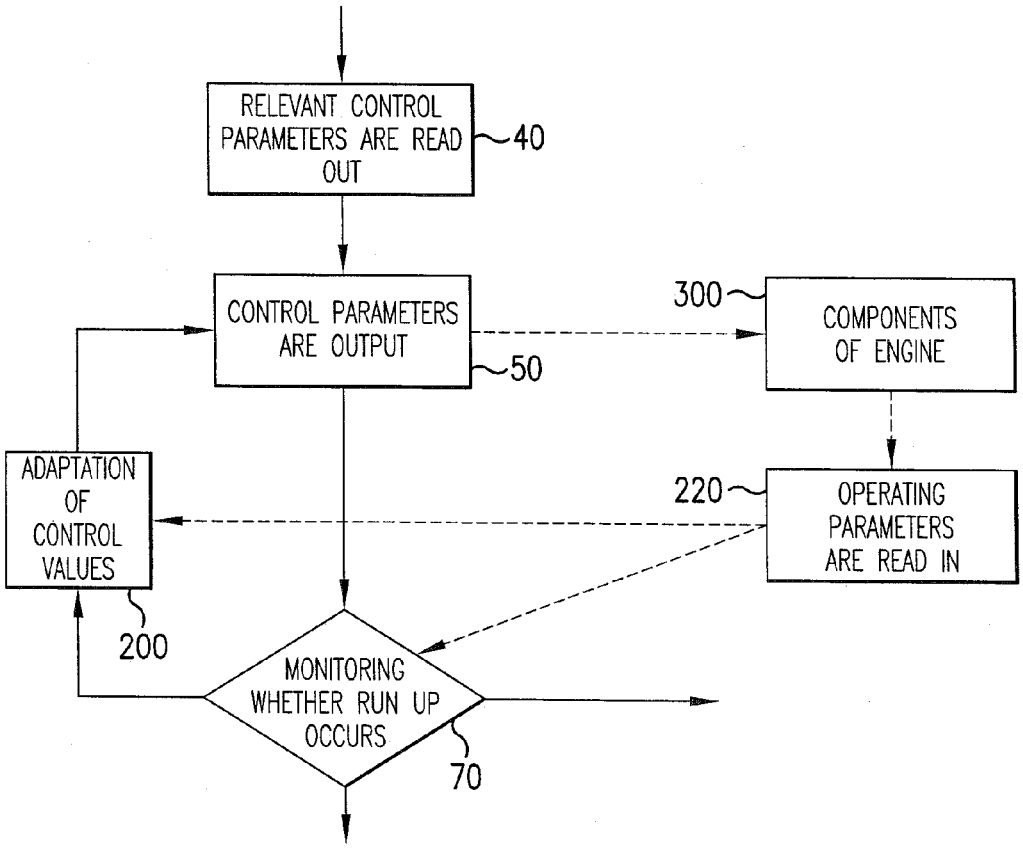
Figure 3:
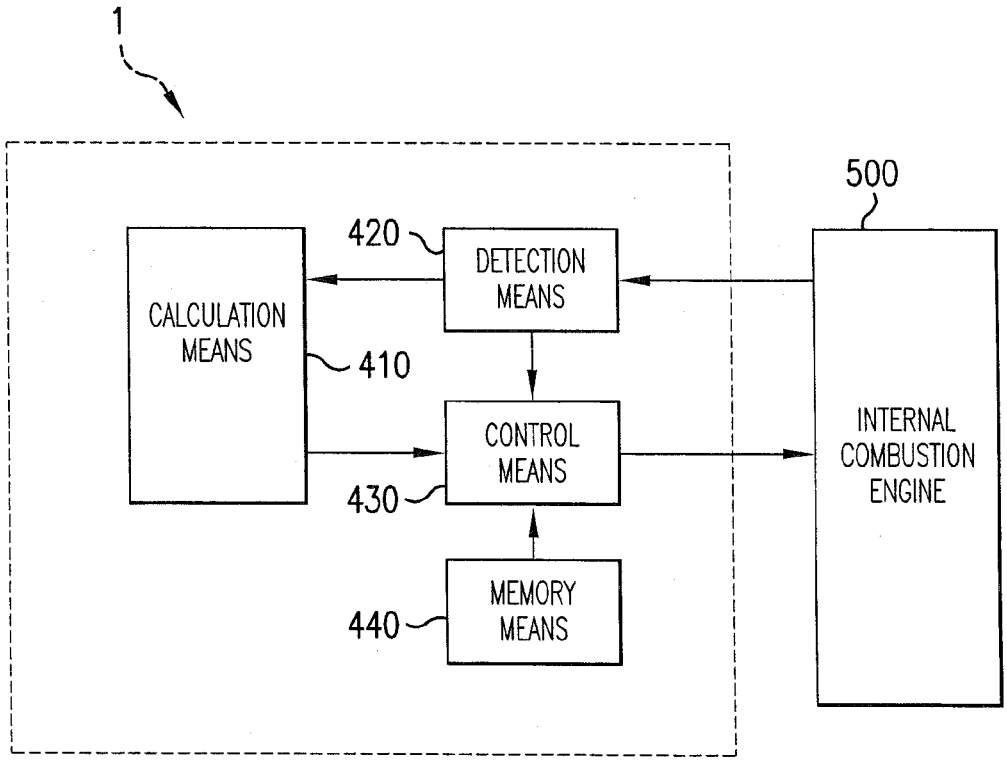

Shown are:

FIG. 1, schematically, a course of a start-and-stop operating mode;

FIG. 2, schematically, monitoring of the runup of the engine to operating speed;

FIG. 3, schematically, a control unit of the invention.

DESCRIPTION

The invention is based on the concept that even before the starting of the engine, on the basis of detected or ascertained operating parameters, a starting strategy is defined on the basis of which control parameters for the runup to engine operating speed are defined.

Particularly in direct-injection internal combustion engines, it is helpful to ascertain the piston position of the cylinder that enters compression first, and in engines with intake-manifold injection to ascertain the piston position of the cylinder that enters the intake phase first.

For identifying the starting cylinder, an absolute angle sensor can for instance be used, which is mounted on the camshaft and/or crankshaft and indicates the instantaneous angular position of the crankshafts. The absolute angle sensor also makes it possible to synchronize the control unit with the engine faster than is possible with the conventional synchronizing methods using reference marks on the crankshaft transducer wheel and/or on a phase transducer wheel on the camshaft.

FIG. 1 schematically shows the course of a start-and-stop mode of operation according to the invention. In step 10, the control unit is in a prestarting phase. In the start-and-stop operating mode, the ignition (KL15) either remains on or is briefly supplied with current at defined time intervals, so that the control unit is regularly connected with the supply voltage. As a result, the otherwise required resynchronization of the control unit with the engine upon starting becomes unnecessary, and the various operating parameters of relevant engine functions are updated at regular intervals. Alternatively, this task can also be taken on by only a special partial function in the control unit during the stopped phase, so that the entire control unit need not always be activated.

In step 20, relevant operating parameters are then detected. The following operating parameters are possible examples as input variables: starting cylinder, piston position, engine temperature, engine oil temperature, coolant temperature, intake air temperature, ambient air temperature, catalytic converter temperature and fuel temperature, fuel rail pressure, ambient air pressure, fuel quality, battery voltage, valve control times, valve stroke, compression ratio, gear, clutch, position of the throttle valve, gas pedal position, brake pedal position, time, and others.

Based on the operating parameters detected or ascertained, a starting strategy is determined, on the basis of which control parameters for a runup to engine operating speed are defined. A starting strategy may for instance take a cold or hot start into account or may be oriented to a start-and-stop operating mode or to achieving a fast runup to engine operating speed, or to design a runup to engine operating speed such that self-ignition operating states are avoided.

In step 30, it is monitored whether the starting strategy can be executing. If conditions are unfavorable or unmet for the starting strategy, then a jump is made to step 100, in which it is decided whether a subsequent cylinder in the ignition sequence is selected—step 100—or an alternative starting event is initiated—step 120.

If suitable conditions for executing the starting strategy do exist, then in step 40 relevant control parameters are read out.

Relevant control parameters are for instance the instant of injection, angle of injection, and injection quantity; the instant and angle of ignition; the engine torque to be output; the chronological duration or angular duration of the triggering of the starter; valve control times and stroke; compression ratio; position of the throttle valve, exhaust gas recirculation valve, and others.

In step 50, the control parameters are output to the various components, and in step 60, the start of the engine then takes place.

In the next step 70, preferably after an initial working stroke, it is monitored whether the control parameters have led to a runup to engine operating speed that is in accordance with the starting strategy while avoiding the predicted self-ignition. If deviations occur, the control parameters are adapted in step 200 such that the desired runup to engine operating speed is attained. In step 50, the new control parameters are then output to the components. Step 60 is skipped in this cycle, and in step 70 it is monitored again whether the runup to engine operating speed is taking place in accordance with the starting strategy. If deviations occur, the control values are optionally adapted again via step 200.

As a fallback position in the event that the start was unsuccessful, upon the monitoring in step 70 a jump is made to step 120, in which an alternative starting event is then initiated.

If starting is successful, step 80 follows, in which the engine is put into normal operation.

In the event of a stop request, the shutoff of the engine is done either regulated or unregulated, depending on the shutoff concept. With a jump to step 90, an unregulated engine shutoff is initiated, in which the crankshaft runs freely to a stop without being influenced. If a regulated engine shutoff is contemplated, step 190 follows. A regulated engine shutoff seeks to shutoff an engine and especially the crankshaft in a defined state, so that in the next start an optimal piston position is attained in terms of the starting time, fuel consumption, emissions, the load on the on-board electrical system, etc.

After the engine shutoff in step 90 or 190, a return is made to the prestarting step 10, and a new operating cycle can begin.

If in step 30 no conditions for executing the starting strategy are found, then a jump is made to step 100 as described. Preferably, the attempt is made to find a cylinder for which the conditions are met, or in other words in which the cylinder has a suitable piston position. Hence step 100 as a rule leads first to step 110. Here the next cylinder in the ignition sequence is selected, and a jump is made to step 20, so that the routine can begin again. If in step 30 no suitable condition is again recorded, then typically in step 100 the loop is repeated until such time as all the cylinders have been polled. If no suitable condition still exists, then step 100 jumps to step 120 and initiates an alternative starting event.

In step 120, the present starting strategy is first discontinued. One possible starting alternative is to keep control parameters in readiness for a nonoptimized runup to engine operating speed. These control parameters may for instance be selected such that for the injection and the ignition, standard values are used, but for a preferred starting strategy, such as a start-and-stop operating mode, the starter can conversely be triggered with control parameters. A further alternative that can be provided is to initiate a "classical" normal start, in which the starter is operated in the conventional way.

In the next step 130, the control parameters are output to the components, after which the start takes place in step 140, and then in step 70 it is checked whether the start was successful.

In the event that the engine has not started, then from step 70 a return is made to step 120, and a new attempt at starting is made. After repeated failure to start, provision may also be made to initiate suitable error reactions.

FIG. 2 shows the steps in detail after starting of the engine in step 70. As already described in conjunction with FIG. 1, control values for the starting strategy are read out in step 40 and are output in step 50 to components 300 of the engine, and then in starting takes place in step 60 (not shown in FIG. 2). After the engine is started, operating parameters are read in, for instance continuously or at defined time intervals, in a step 220, essentially independently of the other steps, so that a chronological course of relevant operating parameters can optionally be ascertained.

After the onset of starting, in step 70, on the basis of the operating parameters ascertained in step 220, it is checked whether a runup to engine operating speed in accordance with the specified starting strategy is taking place. If the ascertained operating parameters deviate from the operating parameters expected for the starting strategy, then in step 200 the control values are adapted such that the desired runup to engine operating speed is achieved. The new control values are output to the components 300 in step 50, and the success is checked in step 70, and if there are still deviations, a return is made is made to step 200 again.

In FIG. 3, a device 1 for controlling an internal combustion engine 500 is shown, outlined in dashed lines. The device 1, preferably a control unit, includes a calculation means 410, a detection means 420, a control means 430, and a memory means 440.

The detection means 420, preferably a receiver, analog-to-digital converter, or the like, detects operating parameters of the engine and carries signals accordingly onward to the calculation means 410 and the control means 430. The calculation means 410, preferably a microprocessor or in general an arithmetic unit, calculates or ascertains, from the detected operating parameters, a starting strategy suitable for starting the engine and defines control parameters such that the runup to engine operating speed takes place in accordance with the desired starting strategy. The control parameters and optionally the starting strategy are sent onward to the control means 430. The control means 430 may for instance be constructed as a separate unit or it may be part of the functionality of the calculation means 410. Via the control means 430 and optionally other function modules, components of the engine are triggered with the defined control parameters. The control means 430, on the basis of detected operating parameters, checks whether the runup to engine operating speed upon starting is in accordance with the specified starting strategy. If the runup to engine operating speed or certain operating parameters deviate from the parameters expected for the starting strategy, then for attaining an optimal runup to engine operating speed in accordance with the desired starting strategy, the control means 430 adapts the control parameters accordingly. The adapted control parameters are stored in memory in a memory means 440, so that for a new start with a suitable starting strategy, already-adapted values are available.

For outputting the control parameters in accordance with the starting strategy, the control parameters may for instance be stored in memory in families of curves, characteristic curves, special truth tables, memory units of a neural network, or other memory units, and can also be learned adaptively, so that starting that is optimized in terms of time, fuel consumption and emissions is always achieved.

As a function of the operating parameters, the optimal starting strategy and corresponding control parameters are ascertained and defined, for attaining optimal starting conditions for the engine. If despite the preselected control parameters nonoptimal operating states nevertheless ensue, such as fuel engine vibration, then in a start-and-stop mode of operation, for instance, the control parameters are selected for the next start such that a recurrence of these effects is prevented. However, it must then be assured that by the new choice of what are now not optimally selected precontrol variables, 100% starting reliability is nevertheless attained; optionally, the precontrol values must also be adapted.

Alternatively, a switchover can be made to operation using classical starter starting (that is, making the starter turn over longer). The same is true after a start has been discontinued or in an unsuccessful attempt at starting during a start-and-stop operating mode.

If in general the conditions for a successful "starter-reinforced direct start", for instance after polling the ambient conditions, are not entirely met in the engine before starting for the applicable starting cylinder, for instance in the case where the piston position of the starting cylinder is not optimal, then it is also possible by means of turning over the starter to change the next cylinder in the ignition sequence from the intake stroke to the compression stroke and to execute the starting routine with this cylinder.

A device or control unit according to the invention with engine control functions programmed in it makes it possible to output injection pulses and ignition pulses separately from one another and at arbitrary times or crankshaft angles. It also makes it possible to trigger an electrical machine, such as a starter or starter-generator, with variable timing or variably over the camshaft or crankshaft angle. It also makes it possible, in systems with variable compression or valve control, to vary the compression ratio, or the phase and stroke position of the inlet and outlet valves, during the starting procedure.

In systems with variable valve control, either the fill level in the compression phase or the engine torque output can also be controlled by adjusting the valve control times for the inlet and outlet camshafts. In the compression phase, the fill level in the compression cylinder can be varied as a function of ambient conditions in the engine, for instance by earlier or later closure of the injection valve.

With a view to regulating the output engine torque for the sake of avoiding engine vibration upon starting, some of the energy combustion can be output to the outlet conduit, for instance by earlier opening of the outlet valve, so as to reduce the engine torque effectively. Conversely, the control time of the outlet camshaft can also be altered in the direction of "outlet valve opens late", to enable utilizing the combustion torque over a greater crankshaft angle range.

One possible starting strategy can for instance provide a special regulation algorithm and thus predict or simulate the temperature course during the compression phase, for instance on the basis of the compression ratio and/or the valve control times, the mass of air enclosed in the cylinder, and the starter rpm. After that, the output variables of the regulating algorithm or the control values can be set such that a critical temperature for the self-ignition is not exceeded.

In systems with variable compression, it is additionally possible during the compression and combustion process to vary the compression ratio, so as to control the compression temperature and the compression pressure. If it is found from a temperature or combustion chamber pressure sensor, for instance, that the compression temperature or the compression pressure is too high, then the engine compression is decreased (causing expansion of the cylinder for a greater displacement). Conversely, if the compression temperature or the compression pressure is too low for optimal mixture preparation, then the compression ratio of the engine is increased.

In the procedure according to the invention, the problem of self-ignition at high engine temperatures is averted by means of purposeful adaptation of compression, injection and ignition. By jointly optimizing the starter triggering and the combustion, this starting variant additionally offers great potential for shortening the starting time.

The procedure according to the invention makes it possible to base the starting strategy and the runup to engine operating speed essentially on two principles: a performance-optimized triggering of a starter, as a provision that reinforces or prepares for starting, and optimized control or regulation of the initial combustions until the set-point idling rpm is reached.

The prior triggering of a starting as a starter-reinforced provision is done in such a way that in the first passage through top dead center, the starter rpm attains an optimal rpm for the ensuing combustion. This can mean on the one hand that as a function of the piston position in the compression stroke upon starting, the starter is performance-controlled such that at the passage through top dead center, the maximum possible engine rpm, for instance (that is, kinetic energy, or torque) is attained. a defined temperature increase or pressure increase in the combustion chamber is attained during the compression. On the other hand, however, the triggering of the starter can also be done such that during the compression phase, based on the starter rpm, an optimal mixture preparation time for the subsequent combustion is created. This means that on the basis for instance of the fuel quality, the engine temperature, coolant temperature, or oil temperature, the engine compression and so forth, the starter rpm, or the resultant piston speed is controlled such that in the compression phase, the most homogeneous possible fuel-air mixture is formed in the cylinder and is then ignited.

By purposeful monitoring of the combustion chamber temperature, for instance by means of a temperature sensor, or of a pressure course by means of a combustion chamber pressure sensor, the compression temperature, for instance, can be kept below the critical temperature for a self-ignition, by purposefully allowing wall heat losses to the cylinder wall during compression.

In both variants, the starter accordingly furnishes an initial torque, to which then the combustion torque, generated by the initial combustion, is added together to make a total engine torque. The result is finally the increase in rpm upon the runup to engine operating speed. Additionally, depending on the starting position, the starter is triggered on the basis of either angle or time only as long as is necessary to assure the predefined rpm upon passing TDC. That is, as early as possible, the starter is actively turned off again, to avoid unnecessary loads on the on-board electrical system or starting noise.

As a result of this collaboration of the optimized starter torque and combustion torque and optimal starter triggering, a very short starting time is achieved, which makes this system especially attractive for both a start-and-stop system and in general for faster starting of an engine and simultaneously represents a marked plus in terms of passenger comfort.

As the starting cylinder for the first combustion, the cylinder in the compression stroke is used, which is identified before the start, for instance by means of an absolute angle sensor on the crankshaft.

As described, it is also provided that fuel be injected into the cylinder and that the fuel-air mixture then be ignited not primarily before or during the compression phase in the compression cylinder, but only after top dead center has been passed, or in other words once the piston is already in the expansion phase of the working stroke.

The course of the injection and ignition can be based on time or angle or both. This starting method can also be employed on the second and further combustion events that follow in the ignition sequence, so that starting that is optimized in terms of time, fuel consumption and emissions can be achieved.

In other words, the starting routine, as shown in FIG. 1 or FIG. 2, regulates the various parameters (instant of injection, injection quantity, instant of ignition) for the subsequent combustion, on the basis of the rpm or rpm gradient course of the previous combustion, in order to attain starting that is optimized in terms of time, fuel consumption, and emissions.

Moreover, by means of the targeted adaptation of the engine torque (for instance, a smaller injected fuel quantity, a later instant of injection), engine vibration, which may occur because of the initial combustions (that is, full-load compressions or full-load combustion events) and can be annoyingly transmitted to the passenger compartment (lessening passenger comfort) can be minimized or prevented.

Last but not least, however, as a result an overswing in rpm past the desired idling rpm, of the kind that at present usually occurs in the starting process, can be reduced, so that the engine reaches its desired operating state faster. Attaining the desired engine operating state quickly is essential in the start-and-stop operating mode for the sake of a fast takeoff, for instance after stopping at a light. A reduced overswing in rpm also has an effect on the starting noise of the engine. Engine "screeching" because of an excessively high rpm in starting is thus effectively prevented.

Alternatively, the injection pulses and ignition pulses can be made, as a function of the aforementioned input variables or operating parameters, also before or during the compression phase, however, or in other words even before top dead center is reached. Then, however, on the basis of the input variables (such as engine, coolant, oil, and intake air temperature, and so forth), it must be assured that any self-ignition effects can be reliably precluded.

This can be achieved as described above, for instance by targeted triggering of the starter, for instance by monitoring the compression temperature and keeping it below a critical temperature threshold for the self-ignition by means of targeted wall heat losses to the cylinder wall.

A further alternative is as described an increased injection quantity (enrichment) for the initial combustions, since thus the air enclosed in the cylinders is cooled down more strongly (greater vaporization enthalpy), and the temperature in the combustion chamber can thus be brought to below the self-ignition temperature.

The invention is furthermore suitable for a start-and-stop system in vehicles with intake-manifold injection (SRE). The injection pulses for the individual cylinders must be made here during the intake stroke with the inlet valves open or must be stored in advance in the intake manifold while the inlet valves are still closed. Thus even in these systems, both in hot starting and for instance during the start-and-stop mode of operation, and in cold starting, the starting time can be shortened markedly and the runup to engine operating speed can be designed in a way that is optimized in terms of time, fuel consumption, and emissions.

However, in both applications, because of the injection options which are limited to the intake stroke, the starter has to be triggered longer than in systems with direct injection. Nevertheless, once again optimal starter triggering can be attained.

If the piston of the starting cylinder is in the intake stroke, for instance close to top dead center with the inlet valves opened, then starting is already done from that cylinder. The injection timing and ignition timing can be selected freely here as well. However, depending on the peripheral conditions prevailing in the engine (such as rail pressure, fuel temperature, etc.), in choosing the instant of injection the fact must be taken into account that if the starter is running, the fuel quantity required for the mass of air aspirated in the cylinder, for instance for stoichiometric combustion, can already be completely injected into the cylinder even before the closure of the inlet valves.

To that end, beginning at a starting position near top dead center, the starter must be triggered over at least one crankshaft revolution (360θKW), until the starting cylinder has concluded its compression stroke and is in the working stroke.

If the cylinder in the intake stroke is close to bottom dead center (BDC) or is just before the end of the intake stroke (that is, the inlet is closing), so that first, there is not enough time to put the required fuel quantity in place before the inlet closes, and second, no further significant turbulence is created in the cylinder by the aspirated air, then a shift is made to the next cylinder in the ignition sequence as the starting cylinder, which has the advantage of better mixture preparation. That cylinder must then first be transferred from its expulsion stroke to the intake stroke, which would mean triggering the starter by an angle or a time of more than one crankshaft revolution (>360θKW).

In the ideal case, when the starting cylinder is in a middle position in the intake stroke (approximately 90θKW), the result for starter triggering is an angle or a time of three-quarters of one crankshaft revolution (approximately 270θKW). The starter triggering then takes only slightly longer than the maximum triggering time of the starter of approximately one-half a revolution of the crankshaft (approximately 180θ of crankshaft angle), and direct gasoline injection systems with injection into the compression stroke. The starter is triggered in the same way as described for the systems with direct injection, to attain starting that is optimized in terms of time, fuel consumption, and emissions.

The risk of self-ignition at high engine temperatures must be prevented in SRE start-and-stop systems, for instance by an increased injection quantity (enrichment) during the intake stroke or just before opening of the inlet valves. By means of a pre-stored injection into the intake manifold shortly before the opening of the inlet valves or during the intake stroke, the aspirated air, which for instance in a stopped phase in the start-and-stop operating mode heats up excessively because of the engine heat output and also from strong sunshine, is cooled down by the vaporization of the liquid fuel. Thus the temperature of the fuel-air mixture is reduced markedly and in the ensuing compression can be kept below the temperature threshold for self-ignition. In the start-and-stop operating mode, worsening of the emissions from an increased injection quantity would be rendered harmless by the already heated-up catalytic converter and would thus be unproblematic. However, it must be assured that during a long stopped phase, for instance, the temperature in the catalytic converter does not drop below the conversion temperature.

The invention claimed is:

1. A device (1) for controlling an internal combustion engine upon starting, having a detection means (420) which detects operating parameters of the engine, characterized in that a calculation means (410), taking the detected operating parameters before the start of the engine into account, specifies a starting strategy;

that the calculation means (410), as a function of the specified starting strategy, defines control parameters for controlling a runup to engine operating speed;

that a control means (430) monitors the runup to engine operating speed;

that the control means (430), in the event of a runup to engine operating speed that deviates from the starting strategy, adapts the control parameters accordingly; and that the calculation means, in an engine with a control selected from the group consisting of a variable valve control and a compression control, control parameters for said control selected from the group consisting of said variable valve control and said compression control correspondingly are defined, such that the runup to engine operating speed follows the specific starting strategy.

2. The device (1) as recited in claim 1, characterized in that the detection means (420) detects a piston position of at least one cylinder;

and that a calculation means (410) specifies a starting strategy, taking into account the at least one piston position detected before the start of the engine.

3. The device (1) as recited in claim 1, characterized in that the detection means (420) detects a piston position of at least one cylinder which is the first to enter compression or an intake stroke upon starting;

and that the calculation means (410) specifies a starting strategy, taking into account at least the piston position detected before a start of the engine.

4. The device (1) as recited in claim 1, characterized in that a memory means stores the control parameters, adapted by the control means (430) upon the runup to engine operating speed, in memory;

and that the control means (430), upon a repeated runup to engine operating speed that deviates from the starting strategy, accesses the control parameters stored in memory.

5. The device (1) as recited in claim 1, characterized in that in an engine with variable valve control, the calculation means (410) defines control parameters for valve control such that the runup to engine operating speed follows the specified starting strategy.

6. The device (1) as recited in at least claim 1, characterized in that in an engine with variable compression control, the calculation means (410) defines control parameters for compression control such that the runup to engine operating speed follows the specified starting strategy.

7. The device (1) as recited in claim 1, characterized in that the starting strategy defines control parameters which trigger a starter or starter-generator variably over time in its performance and/or rpm.

8. The device (1) as recited in claim 1, characterized in that the calculation means (410), as a function of the operating parameters detected before the start of the engine, recognizes a possible self-ignition operating state of the engine and specifies a starting strategy which prevents this self-ignition operating state.

9. A method for controlling an internal combustion engine, characterized in that before a start of the engine, taking detected operating parameters into account, a starting strategy for starting the engine is specified;

that as a function of the specified starting strategy, control parameters for controlling a runup to engine operating speed are defined;

that the runup to engine operating speed is monitored and in the event of a runup to engine operating speed deviating from the starting strategy, the control parameters are adapted such that a runup to engine operating speed specified by the starting strategy is adhered to; and in an engine with a control selected from the group consisting of a variable valve control and a compression control, control parameters for said control selected from the group consisting of said variable valve control and said compression control correspondingly are defined, such that the runup to engine operating speed follows the specific starting strategy.

10. The method as recited in claim 9, characterized in that the starting strategy is specified, taking at least one detected piston position into account.

11. The method as recited in claim 10, characterized in that a piston position of at least one cylinder, which upon starting first enters compression or an intake stroke, is detected.

12. The method as recited in claim 9, characterized in that the control parameters adapted upon a runup to engine operating speed are stored in memory and are accessed again in the event of a repeated runup to engine operating speed that deviates from the starting strategy.

13. A computer program product with a program code, which is stored in memory on a machine-readable medium, for performing the method as recited in claim 8, when the program is executed on a computer or control unit.

* * * * *